US006600269B2

(12) United States Patent
Yoshioka et al.

(10) Patent No.: US 6,600,269 B2
(45) Date of Patent: Jul. 29, 2003

(54) PLASMA DISPLAY PANEL AND METHOD OF MANUFACTURING THE SAME

(75) Inventors: Toshihiro Yoshioka, Tokyo (JP); Takashi Furutani, Tokyo (JP)

(73) Assignee: NEC Corporation, Tokyo (JP)

( * ) Notice: Subject to any disclaimer, the term of this patent is extended or adjusted under 35 U.S.C. 154(b) by 35 days.

(21) Appl. No.: 09/920,334

(22) Filed: Aug. 2, 2001

(65) Prior Publication Data

US 2002/0047571 A1 Apr. 25, 2002

(30) Foreign Application Priority Data

Aug. 3, 2000 (JP) ..... 2000-235969

(51) Int. Cl.[7] ..... G09G 3/10; H01J 17/49

(52) U.S. Cl. ..... 315/169.4; 315/169.3; 313/584; 313/610; 313/609; 313/620

(58) Field of Search ..... 315/169.4, 169.3, 315/169.1; 313/584, 582, 610, 609, 613, 590, 620, 621

(56) References Cited

U.S. PATENT DOCUMENTS 5,763,139 A * 6/1998 Matsunaga et al. ..... 430/313
6,008,582 A * 12/1999 Asano et al. ..... 313/582
6,043,605 A * 3/2000 Park ..... 313/586
6,160,345 A * 12/2000 Tanaka et al. ..... 313/489
6,353,288 B1 * 3/2002 Asano et al. ..... 313/582

FOREIGN PATENT DOCUMENTS

| | | |
|---|---|---|
| JP | 10-149771 | 6/1998 |
| JP | 11-213896 | 8/1999 |
| JP | 2000-123747 | 4/2000 |

* cited by examiner

*Primary Examiner*—Don Wong
*Assistant Examiner*—Tuyet T. Vo
(74) *Attorney, Agent, or Firm*—McGinn & Gibb, PLLC

(57) ABSTRACT

In a plasma display panel, data electrodes are formed parallel to each other on a first substrate, and a selection voltage is to be applied to them. A dielectric layer covers a surface of the first substrate to include the data electrodes. Linear partitions are formed at a predetermined interval on the first substrate to be parallel to the data electrodes. A second substrate opposes the first substrate. A closed space between the first and second substrates is filled with a gas. Intersections of a pair of sustain discharge electrodes and data electrodes form matrix-like discharge cells. Stepped partitions are formed at a predetermined interval on the first substrate in a direction intersecting the linear partitions.

37 Claims, 15 Drawing Sheets

PLASMA DISPLAY PANEL AND METHOD OF MANUFACTURING THE SAME

BACKGROUND OF THE INVENTION

The present invention relates to a color plasma display panel (color PDP) used as a flat panel display, the area of which can be increased easily, in a display output device for a personal computer or workstation, a wall-hung television, or the like and, more particularly, to the structure of a color PDP in which the brightness is improved and the power consumption is reduced, and a method of manufacturing the same.

A surface discharge type PDP is known well as a conventional PDP. In a surface discharge type PDP, a gas fills a hermetic space between one glass substrate (to be referred to as the second substrate hereinafter) with an electrode pair group covered with a dielectric layer and forming a large number of pairs, and the other glass substrate (to be referred to as the first substrate hereinafter) opposing it. When a voltage is applied to the electrode pairs of the second substrate, electric discharge occurs. Ultraviolet light from this discharge irradiates phosphors, thus displaying visible light emission.

FIGS. 9A to 9C and FIGS. 10A and 10B show the first prior art. According to the first prior art, data electrodes 212 and a dielectric layer 213 are formed on a flat first substrate 211. Then, striped partitions 230 and thereafter a phosphor layer 215 are formed on the resultant structure. Reference numeral 200 denotes a discharge cell; 251, a second substrate; 252, a pair of sustain discharge electrodes; 253, a dielectric layer; and 254, a protective film.

According to the second prior art, a PDP with partitions disclosed in Japanese Patent Laid-Open No. 10-149771 is available. More specifically, as shown in FIGS. 11A and 11B, partitions 330 are formed in parallel crosses on a first substrate 311, and a phosphor layer 315 is formed on the resultant structure. Other than this, a PDP is available in which the discharge cell has a hexagonal shape, and partitions are formed around the discharge cell. Reference numeral 300 denotes a discharge cell; 312, a data electrode; 313, a dielectric layer; 351, a second substrate; 352, a pair of sustain discharge electrodes; 353, a dielectric layer; and 354, a protective film.

According to the third prior art, as shown in FIGS. 12A and 12B, projections 440 are formed on a first substrate 411 in a direction perpendicular to partitions 430 parallel to data electrodes 412, and a phosphor layer 415 is formed to cover the projections 440. Reference numeral 400 denotes a discharge cell; 413, a dielectric layer; 451, a second substrate; 452, a pair of sustain discharge electrodes; 453, a dielectric layer; and 454, a protective film.

According to the fourth prior art, a PDP with partitions as disclosed in Japanese Patent Laid-Open Nos. 11-213896 and 2000-123747 is available. More specifically, as shown in FIGS. 13A and 13B, partitions 520 are formed on a first substrate 511 perpendicularly to continuous linear partitions 530, to be lower than the linear partitions 530. Reference numeral 500 denotes a discharge cell; 512, a data electrode; 513, a dielectric layer; 551, a second substrate; 552, a pair of sustain discharge electrodes; and 554, a protective film.

The following phenomena are seen in the conventional PDPs described above.

As in the first and third prior arts, striped partitions are used, and no barriers are formed in a direction perpendicular to them. Alternatively, if the barriers are low, vacuum evacuation of a discharge cell portion in a PDP fabricating process is performed easily, while divergence of the light along the partitions of light-emitting region causes display unclearness. In order to prevent this, if light-shielding portions are formed at the two ends of the discharge cell in a direction perpendicular to the striped partitions, the light emission brightness decreases undesirably.

If hexagonal partitions or partitions arranged in parallel crosses as in the second prior art are used, vacuum evacuation becomes difficult, and a vacuum evacuation process takes time. In order to avoid this, if the second and first substrates are arranged at a predetermined gap, electric discharge adversely affects adjacent discharge cells so a non-display cell may be unpreferably turned on or the brightness and efficiency decrease.

A structure in which the projections 440 are formed on the phosphor surface may be available, as in the third prior art. In this case, however, the light emission brightness and efficiency are improved only a little. With the structure of the fourth prior art, vacuum evacuation is not improved sufficiently.

SUMMARY OF THE INVENTION

It is an object of the present invention to provide a color PDP in which a light emission brightness and efficiency of a color plasma display are improved to realize a good display quality and a decrease in power consumption, and a method of manufacturing the same with which such a color PDP can easily be manufactured.

In order to achieve the above object, according to the present invention, there is provided a plasma display panel comprising a first substrate, a plurality of selection electrodes which are formed parallel to each other on the first substrate and to which a selection voltage is to be applied, a first dielectric layer covering a surface of the first substrate to include the selection electrodes, a plurality of first partitions formed at a predetermined interval on the first substrate to be parallel to the selection electrodes, a second substrate arranged to oppose the first substrate, a closed space between the first and second substrates being filled with a gas, a plurality of pairs of discharge electrodes which are formed on the second substrate to intersect the selection electrodes and between which a discharge voltage is to be applied, intersections of the pairs of discharge electrodes and the selection electrodes forming matrix-like discharge cells, a plurality of second partitions which are formed at a predetermined interval on the first substrate in a direction intersecting the first partitions and have heights smaller than those of the first partitions, and notched openings formed in the first partitions at intersections of the first and second partitions.

DESCRIPTION OF THE PREFERRED EMBODIMENTS

The present invention will be described in detail with reference to the accompanying drawings.

Figure 1A:
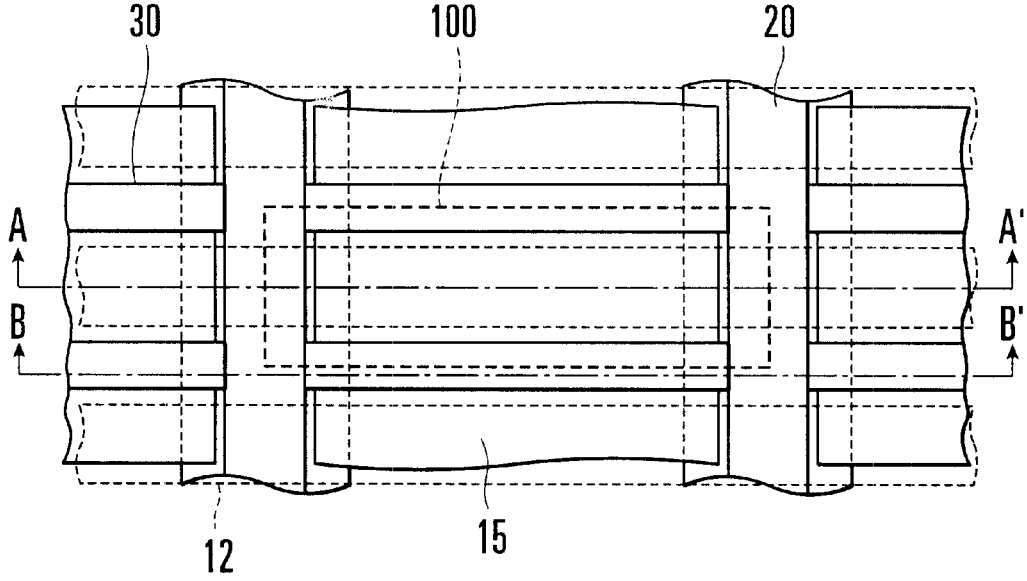
FIG. 1A is a plan view of a plasma display panel (PDP) shown in FIGS. 3A and 3B.
Figure 1B:
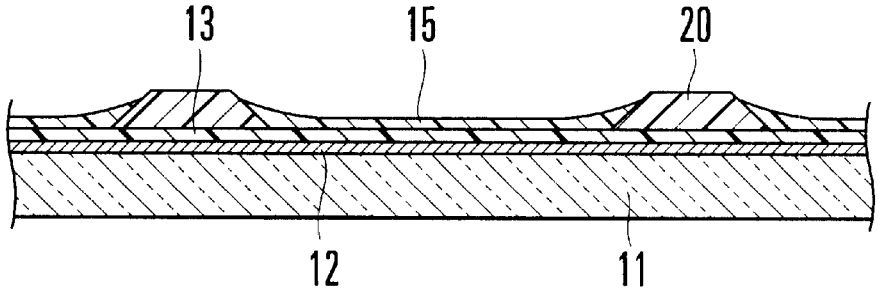
FIGS. 1B and 1C are sectional views taken along the lines A–A' and B–B', respectively, of FIG. 1A.
Figure 1C:
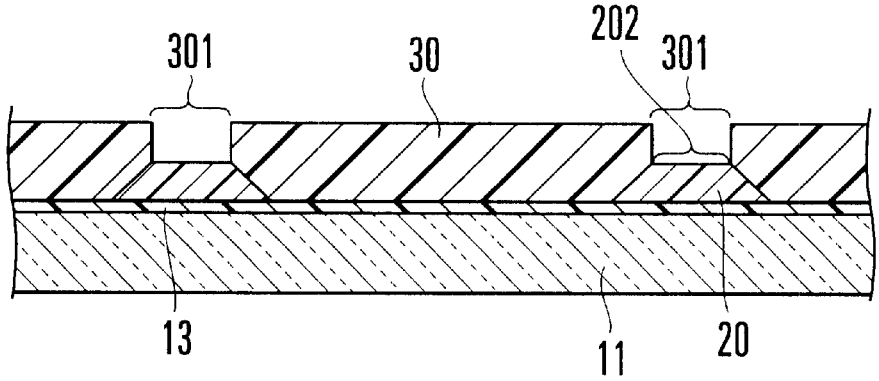

FIGS. 1A to 1C show a PDP substrate according to the first embodiment of the present invention. As shown in FIG. 1B, data electrodes (address electrodes) 12 forming a slitted screen, and a dielectric layer 13 are formed on a first substrate (rear substrate) 11. On the dielectric layer 13, linear partitions are formed between the data electrodes 12, and stepped partitions 20 are formed in a direction perpendicular to the data electrodes 12. As shown in FIG. 1A, a region surrounded by the adjacent stepped partitions 20 and adjacent linear partitions 30 form a discharge cell 100. The stepped partitions 20 are arranged to intersect the linear partitions 30, and are lower than the linear partitions 30. Those portions of the linear partitions 30 where the stepped partitions 20 and linear partitions 30 intersect have notched openings 301 formed to expose flat upper surfaces 202 of the stepped partitions 20, as shown in FIG. 1C. The linear partitions 30 are formed such that they are discontinued at these intersections in the longitudinal direction by the stepped partitions 20 and notched openings 301.

In this embodiment, as shown in FIG. 1C, the notched openings 301 are formed to coincide with the upper surfaces 202 of the stepped partitions 20. However, the present invention is not limited to this. For example, each notched opening 301 may be formed such that its one side surface is located at least above the corresponding upper surface 202 and that its other side surface is located above either the corresponding upper surface 202, the slant surface of the corresponding trapezoidal stepped partition 20, or a position away from the corresponding stepped partition 20. Alternatively, each notched opening 301 may be formed such that its one side surface is located at least on the slant surface of the corresponding trapezoidal stepped partition 20 and that its other side surface is located above either the corresponding upper surface 202, the slant of the corresponding trapezoidal stepped partition 20, or a position away from the corresponding stepped partition 20. Alternatively, each notched opening 301 may be formed large so it accommodates the corresponding stepped partition 20 entirely.

A method of manufacturing the first substrate 11 with respective constituent elements on it will be described in more detail with reference to FIGS. 2A to 2H.

Figure 2A:
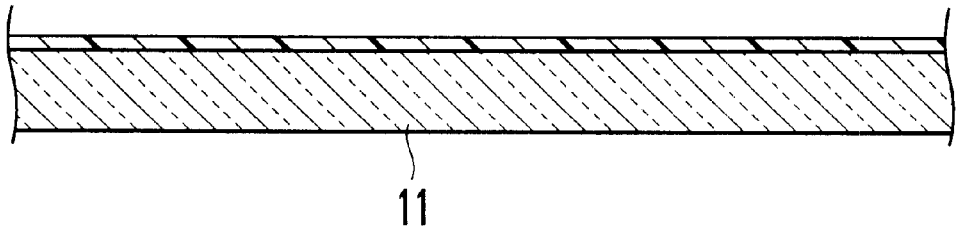
FIGS. 2A to 2H are sectional views showing the steps in manufacturing the PDP substrate shown in FIGS. 1A to 1C.
Figure 2B:
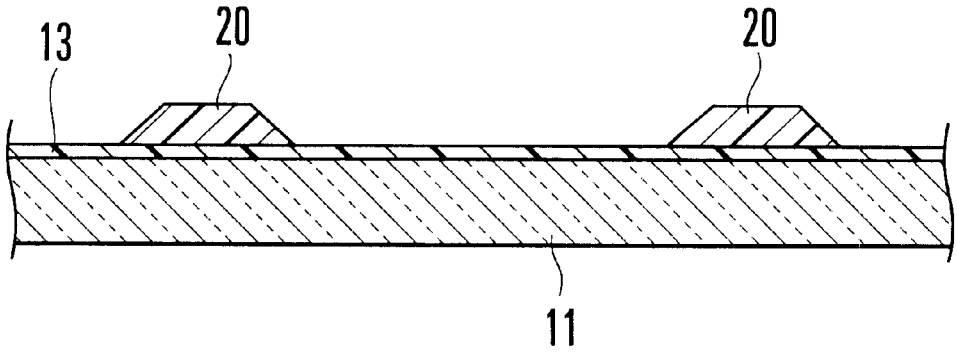
Figure 2C:
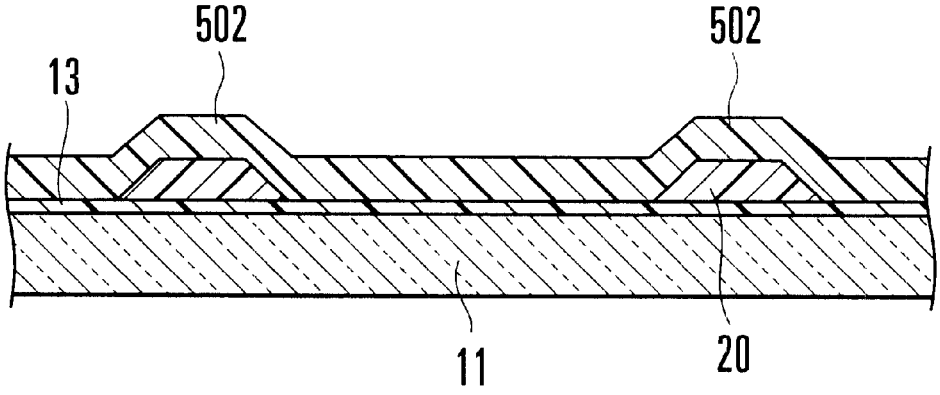

First, data electrodes 12, formed of a metal thin film made of one element or an alloy of aluminum, chromium, copper, and silver or a multilayered film of these elements, a film made of fine metal particles, or a mixture of fine metal particles and low-melting glass, are selectively formed on a first substrate 11 made of a material such as glass. The surface of the first substrate 11 including the data electrodes 12 is covered with a dielectric layer 13 made of low-melting glass (FIG. 2A). After that, stepped partitions 20 are selectively formed by printing or the like to be perpendicular to the data electrodes 12 (FIG. 2B).

Figure 2D:
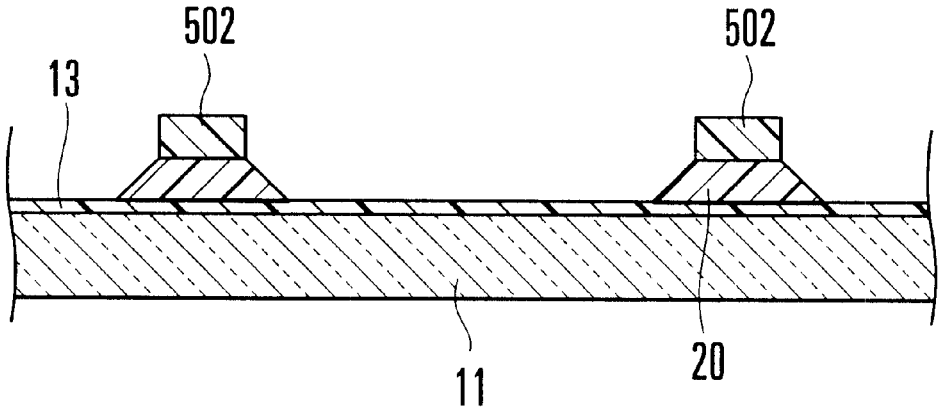
Figure 2E:
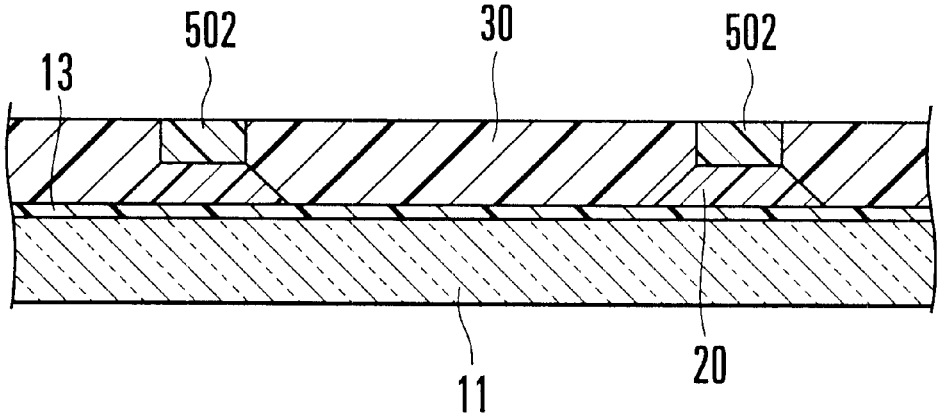
Figure 2F:
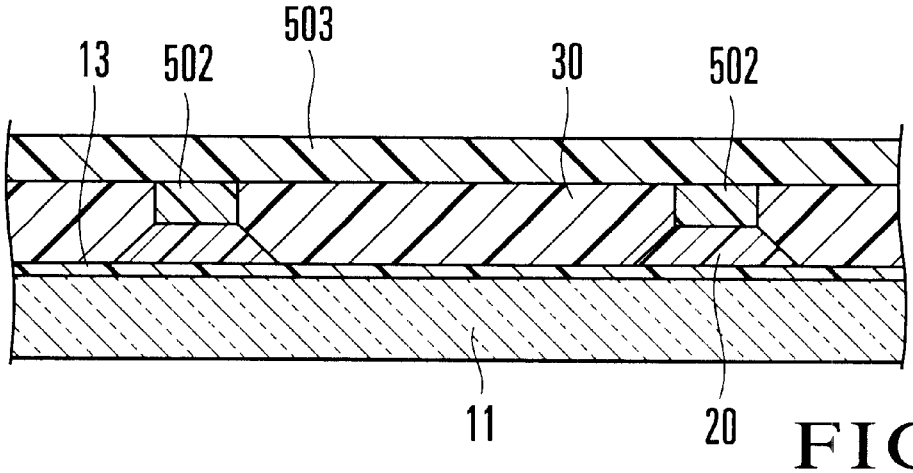
Figure 2G:
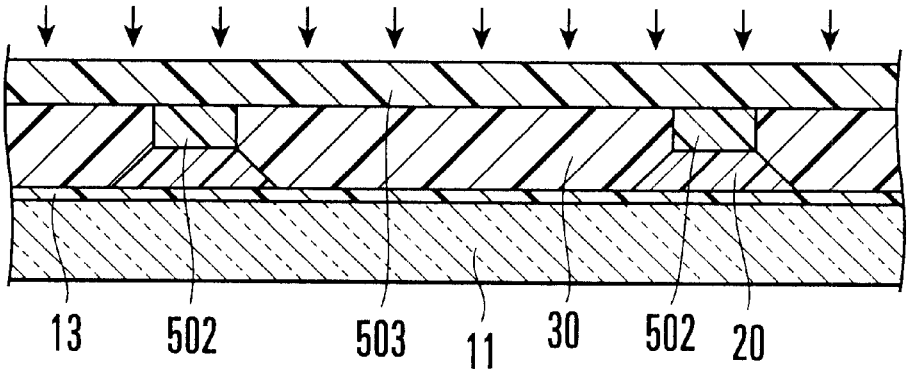
Figure 2H:
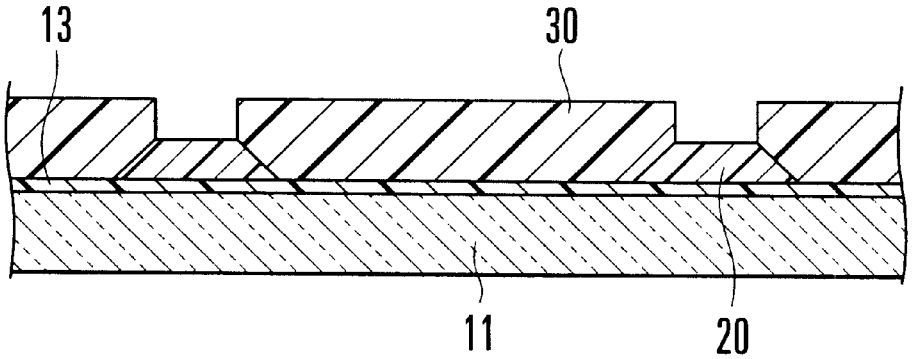

A photosensitive resist material such as a dry film is formed on the dielectric layer 13 and stepped partitions 20 (FIG. 2C), and a patterned photosensitive resist material 502 is left on the stepped partitions 20 (FIG. 2D). The spaces between the stepped partitions 20 are filled with a linear partition material 30 so as to be flush with the substantially patterned photosensitive resist material 502 (FIG. 2E). A photosensitive resist material such as a dry film is formed on the linear partition material 30 and photosensitive resist material 502, and a patterned photosensitive resist material 503 is left to correspond to the regions of the linear partitions including the notched openings (FIG. 2F). The photosensitive resist material 503 is cut by etching such as sandblasting (FIG. 2G). Finally, the photosensitive resist materials 502 and 503 are removed (FIG. 2H). After that, a phosphor layer 15 (FIG. 1B) is formed on the dielectric layer 13 between the stepped partitions 20. Thus, the PDP substrate shown in FIGS. 1A to 1C can easily be manufactured.

The stepped partitions 20 are made of a material containing low-melting glass as the major component. If this material contains white pigment powder, it can realize a high light emission efficiency. The phosphor layer 15 may be formed on the upper surfaces of the stepped partitions 20. Before forming the phosphor layer, a powder layer of a white pigment such as titania may be formed under the phosphor layer 15, so a higher light emission efficiency can be obtained. When the stepped partitions 20 are formed by printing or the like, they may be calcined before forming the linear partitions 30.

In order to further simplify the manufacturing process, a stepped partition material may be formed on the entire surface, and the stepped partitions 20 may be formed by sandblasting or the like. More specifically, a patterned photosensitive material is formed on the stepped partition material first, and then spaces among the patterned photosensitive material are filled with a linear partition material. A striped photosensitive material with notched openings 302 for leaving the linear partitions 30 is patterned on the resultant structure by sandblasting or the like. Then, the stepped partition material and the linear partition material are cut and processed simultaneously by sandblasting or the like, and calcined, to form the stepped partitions 20 and linear partitions 30. In this case, if the stepped partition material and the linear partition material are the same, the process is more simplified.

Figure 3A:
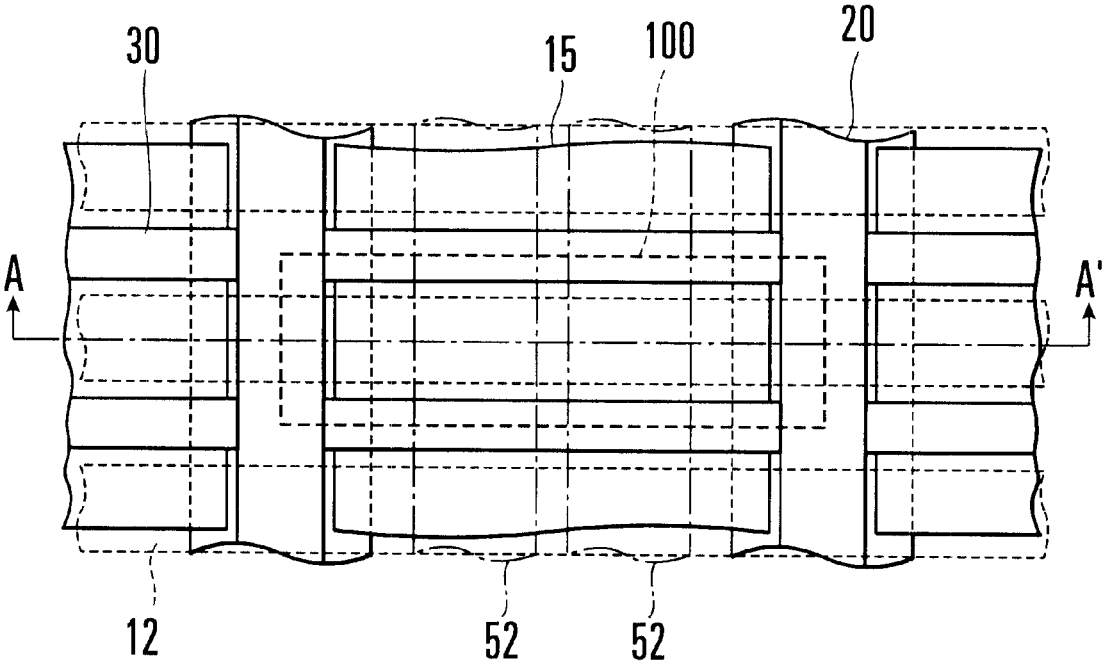
FIG. 3A is a plan view showing a PDP according to the first embodiment of the present invention.
Figure 3B:
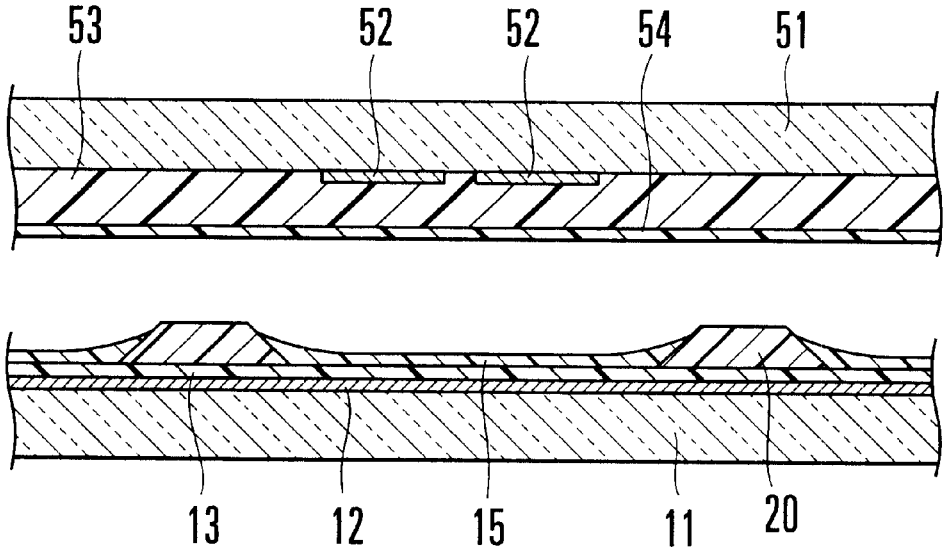
FIG. 3B is a sectional view taken along the line A–A' of FIG. 3A.

FIGS. 3A and 3B show a PDP formed of a first substrate 11 and a second substrate (front substrate) 51 opposing the first substrate 11.

As shown in FIG. 3A, a pair of sustain discharge electrodes 52 forming a slitted screen are formed on the second substrate 51 in a direction perpendicular to data electrodes 12 of the first substrate 11. More specifically, the data electrodes 12 of the first substrate 11 and the pair of sustain discharge electrodes 52 of the second substrate 51 are arranged to form a grid, and their intersections form matrix-like discharge cells 100. When forming the discharge cell 100, the pair of sustain discharge electrodes 52 formed on the second substrate 51 are arranged inside upper surfaces 202 of stepped partitions 20. Each pair of sustain discharge electrodes 52 are made up of a pair of X electrode (common electrode) and a Y electrode (individual electrode) that form a slitted screen. The pair of sustain discharge electrodes 52 are covered with a dielectric layer 53 and a protective film 54 made of magnesium oxide (MgO) or the like. The second substrate 51 and first substrate 11 formed in the above manner are arranged to oppose each other at a predetermined gap, as shown in FIG. 3B. Vacuum evacuation is performed at a high temperature, and a rare gas or a nitrogen-mixed or single-component discharge gas is sealed in the discharge space between the first and second substrates 11 and 51, thus fabricating the PDP (new panel 1) according to the present invention.

In the PDP fabricated in the above manner, ultraviolet light generated by discharge can irradiate the phosphor more effectively without decreasing the exhaust conductance of the vacuum evacuation step indispensable in the panel fabricating process, i.e., without increasing the evacuation time.

A PDP (new panel 1) according to the first embodiment and a conventional PDP were fabricated, and the effect of the present invention was verified.

A PDP according to the fourth prior art described above was fabricated in the same manner as with the method of manufacturing the PDP of the first embodiment, to serve as a prior art panel 1 having partitions 520 with no notched openings. For comparison, a PDP with a structure of the first prior art was fabricated to serve as a prior art panel 2. The new panel 1 and prior art panel 1 have better light emission efficiencies than that of the prior art panel 2. More specifically, the height of stepped partitions 20 was changed, and the light emission efficiency was measured. The effect of improving the light emission efficiency was apparent when the height of the stepped partitions 20 was 0.3 times or more, and preferably 0.5 times or more the height of linear partitions 30.

The heating vacuum evacuation process of panel fabrication was performed by detecting a gas discharged from the panel with a quadrupole gas analyzer. With the new panel 1, the main residual gas component such as hydrocarbon or water decreased, within a period of time equal to that with the prior panel 2, or a period of time shorter than that, to such a level that it did not adversely affect the panel characteristics. With the prior panel 1, however, the decrease in residual gas component was slower than with the prior art panel 2. In particular, when the height of the stepped partitions 20 was 0.8 times or more the height of the linear partitions, the evacuation time increased remarkably.

Figure 4:
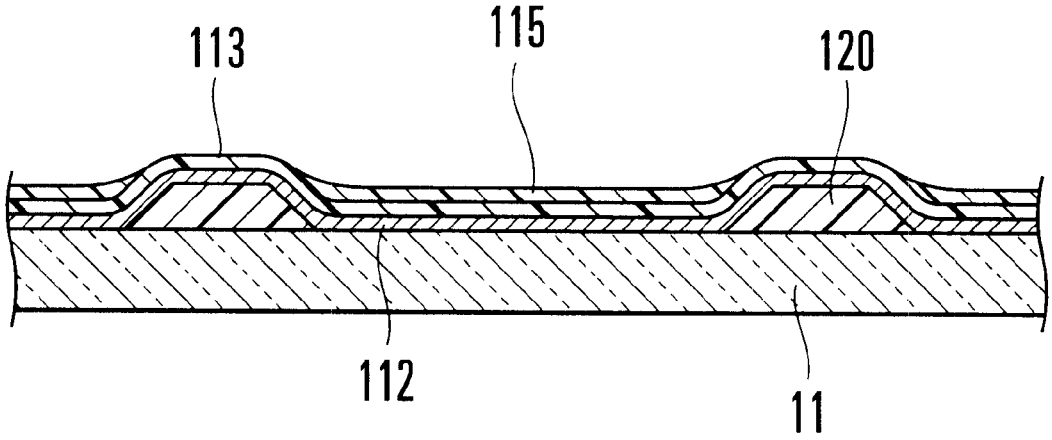
FIG. 4 is a sectional view of a PDP substrate according to the second embodiment of the present invention.

FIG. 4 shows a PDP according to the second embodiment of the present invention. In the second embodiment, data electrodes 112 and a dielectric layer 113 are sequentially formed to extend over the upper portions of stepped partitions 120 and, between the stepped partitions 120, phosphor layers 115 are formed on the dielectric layer 113. In the first embodiment, the data electrodes 12 are hidden under the stepped partitions 20. In the second embodiment, since the data electrodes 112 are formed extend over the stepped partitions 120, discharge that is selectively generated between the data electrodes 12 and one of the pair of sustain discharge electrodes, i.e., write discharge, can be caused easily.

Figure 5A:
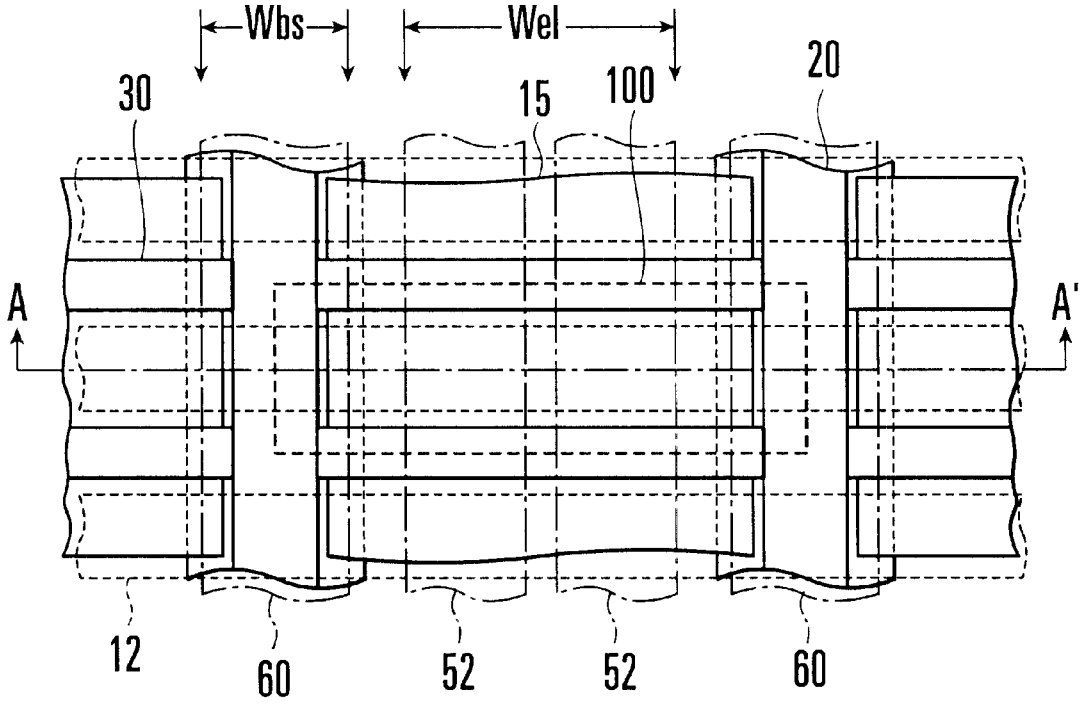
FIG. 5A is a plan view of a PDP according to the third embodiment of the present invention.
Figure 5B:
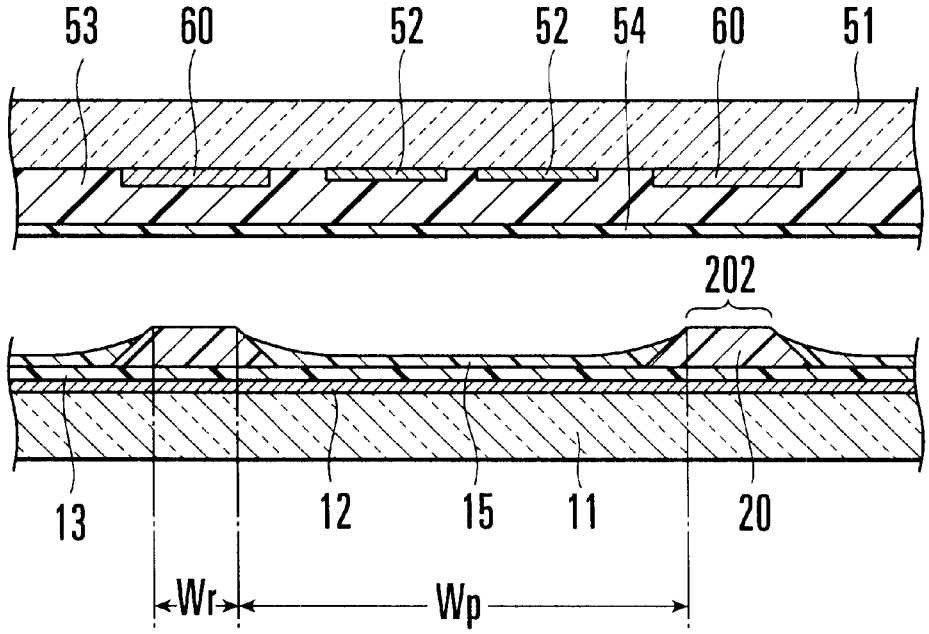
FIG. 5B is a sectional view taken along the line A–A' of FIG. 5A.

FIGS. 5A and 5B show a PDP according to the third embodiment of the present invention. In this embodiment, light-shielding portions 60 for shielding light emission from cells and suppressing reflection of external light are formed on a second substrate 51 to correspond to upper surfaces 202 of the stepped partitions. When the light-shielding portions 60 are formed on the second substrate, unnecessary light-emitting regions or external light reflecting regions can be reduced, so that a high contrast can be obtained. Therefore, the PDP according to this embodiment can improve the light emission efficiency and display quality.

An experimental result proving that the PDP according to this embodiment achieved a high light emission efficiency will be described hereinafter.

Let Wel be the width of a pair of sustain discharge electrodes 52 on the second substrate 51, Wbs be the width of each light-shielding portion 60, Wr be the width of the upper surface 202 of each stepped partition 20 on a first substrate 11, and Wp be the gap between the upper surfaces 202 on the stepped partitions 20, as shown in FIG. 5A. These values were changed, and the light emission characteristics were evaluated. Consequently, when Wel was 1 to 1/1.5 times Wp, the effect of improving the light emission efficiency was apparent. When Wbs was 0.8 to 1.2 times Wr, a decrease in light emission efficiency was small, and the effect of improving the contrast was apparent. When Wr fell within the range of 0.3 to 0.5 times the length (Wr+Wp) of the discharge cell 100, the effect of improving the light emission efficiency and contrast was apparent.

To verify the effect of this embodiment, almost black light-shielding portions 60 were formed on those portions of the second substrate which corresponded to the upper surfaces 202 of the stepped partitions 20 of the first substrate of the new panel 1, thus fabricating a new panel 2. When similar light-shielding layers were formed on the prior art panel 2 described above, although the reflectance of the panel surface decreased to improve the contrast, the light emission efficiency decreased. In contrast to this, in the new panel 2, since the light-emitting region is almost inside the light-shielding portions 60, a high contrast was realized without substantially adversely affected by the light-shielding portions 60 while minimizing a decrease in light emission efficiency.

Figure 6A:
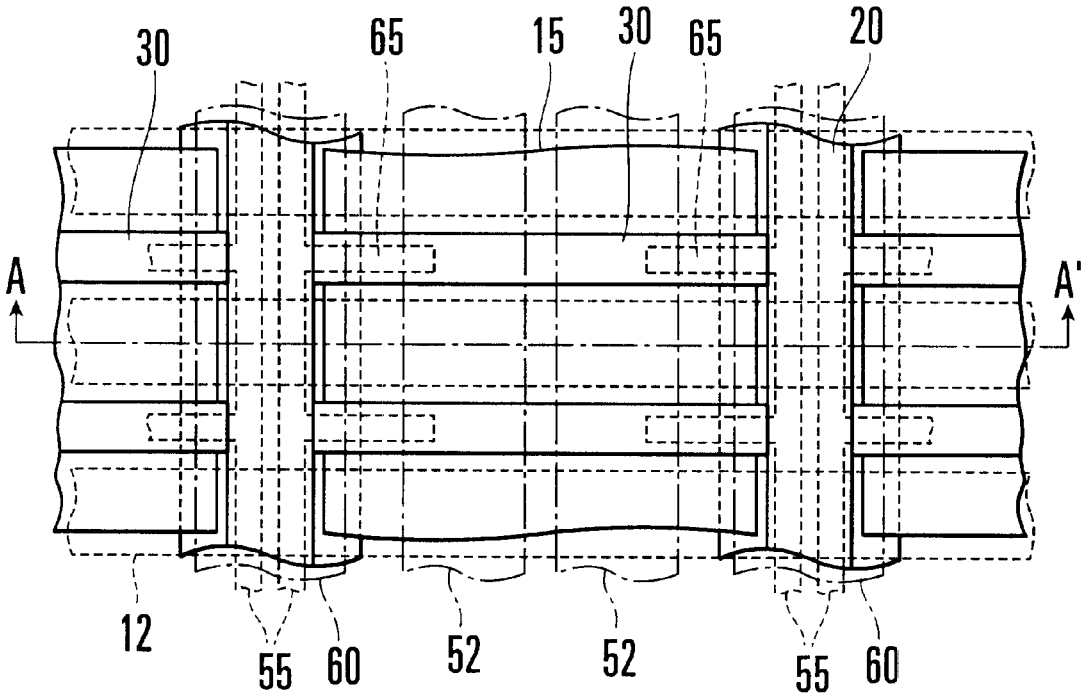
FIG. 6A is a plan view of a PDP according to the fourth embodiment of the present invention.
Figure 6B:
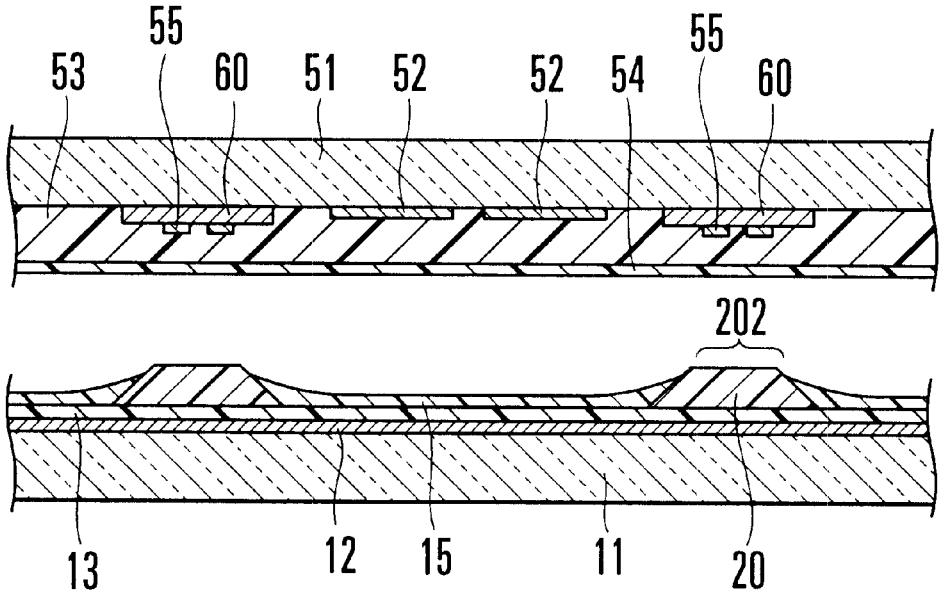
FIG. 6B is a sectional view taken along the line A–A' of FIG. 6A.

As shown in FIGS. 6A and 6B, trace electrodes 55 for decreasing the interconnection resistance of the pair of sustain discharge electrodes 52 could be formed to overlap the light-shielding portions 60. Therefore, a high light emission efficiency was realized without being adversely affected by light shielding performed by the trace electrodes 55. If connecting portions 65 for connecting the trace electrodes 55 and the pair of sustain discharge electrodes 52 are formed to overlap the linear partitions 30, the influence of light shielding can be minimized.

FIGS. 6A and 6B show a PDP according to the fourth embodiment of the present invention. In this embodiment, trace electrodes 55 for decreasing the wiring resistance of a pair of sustain discharge electrodes 52 are formed to overlap light-shielding portions 60, and the interconnections and the pair of sustain discharge electrodes 52 are connected to each other. According to this embodiment, the resistances of the interconnections extending from the pair of sustain discharge electrodes 52 can be decreased by utilizing the light-shielding portions 60, so the uniformity of the display quality of the entire PDP can be improved.

Figure 7A:
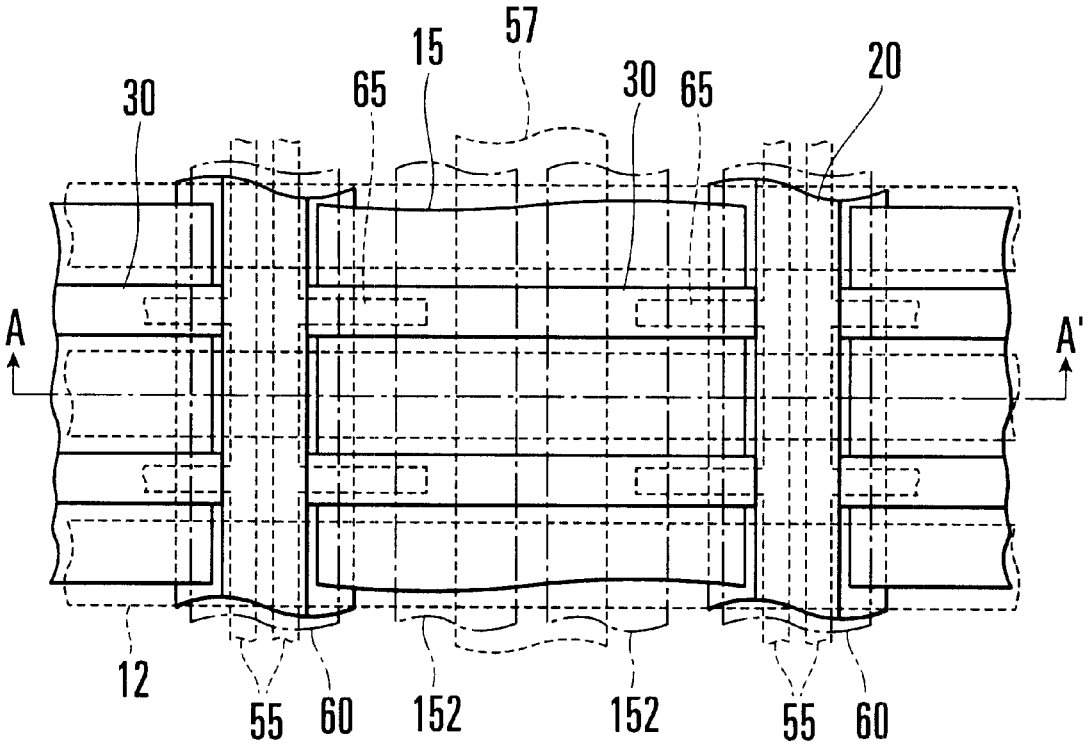
FIG. 7A is a plan view of a PDP according to the fifth embodiment of the present invention.
Figure 7B:
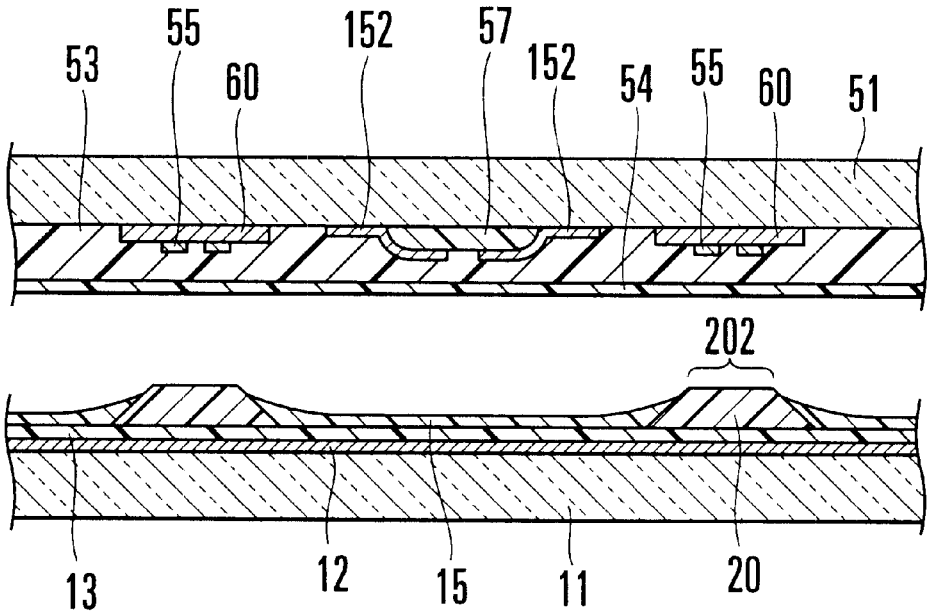
FIG. 7B is a sectional view taken along the line A–A' of FIG. 7A.

FIGS. 7A and 7B show a PDP according to the fifth embodiment of the present invention. In this embodiment, an underlying dielectric layer 57 is formed under the discharge gap of a pair of sustain discharge electrodes 152, so the opposing portions of the pair of sustain discharge electrodes 152 can be formed to project toward the discharge space of the discharge gap. Hence, that portion of a dielectric layer 53 which is on the electrodes formed on these projecting portions can be formed thinner than other portions thereof.

According to this embodiment, the current density of surface discharge can be suppressed while maintaining a high field strength in the discharge space around the ends of the opposing electrodes. Consequently, a decrease in discharge/maintenance voltage and an increase in light emission efficiency can be realized simultaneously, thereby improving the display quality.

Figure 8A:
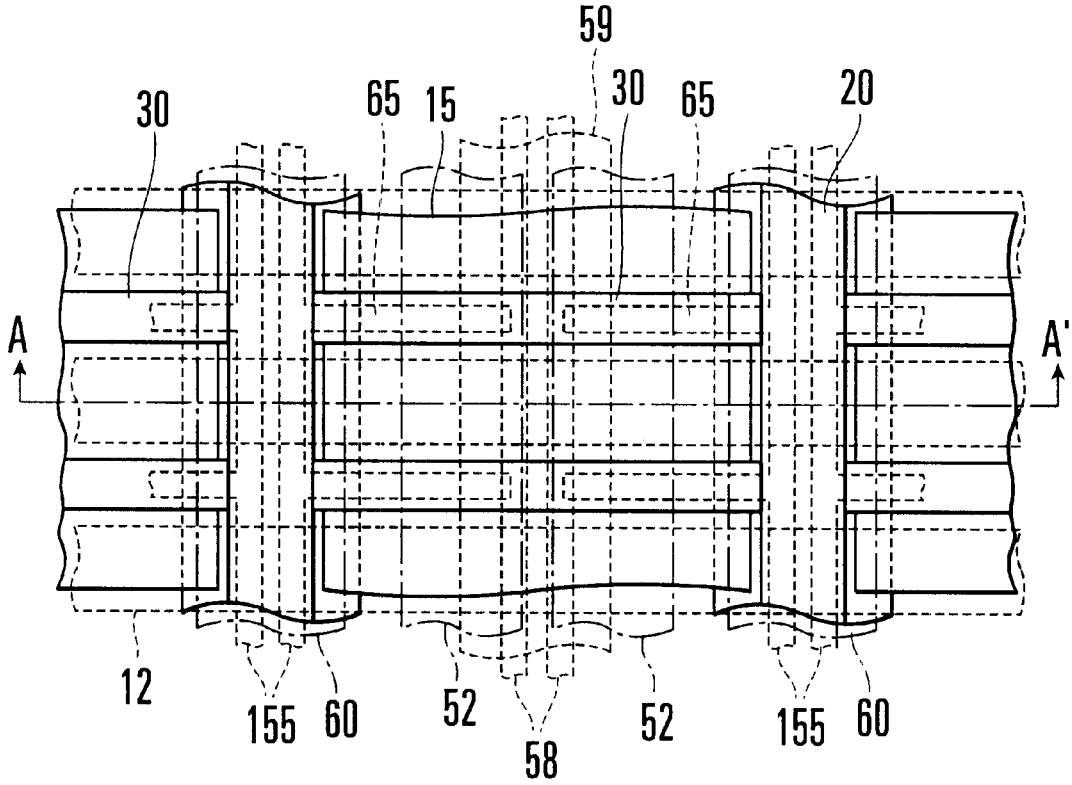
FIG. 8A is a plan view of a PDP according to the sixth embodiment of the present invention.
Figure 8B:
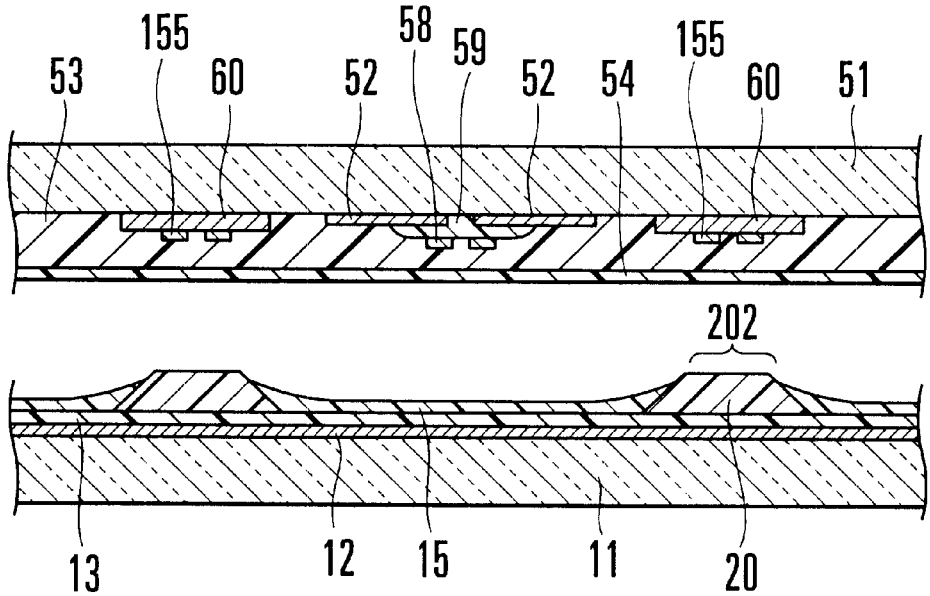
FIG. 8B is a sectional view taken along the line A–A' of FIG. 8A.
Figure 9A:
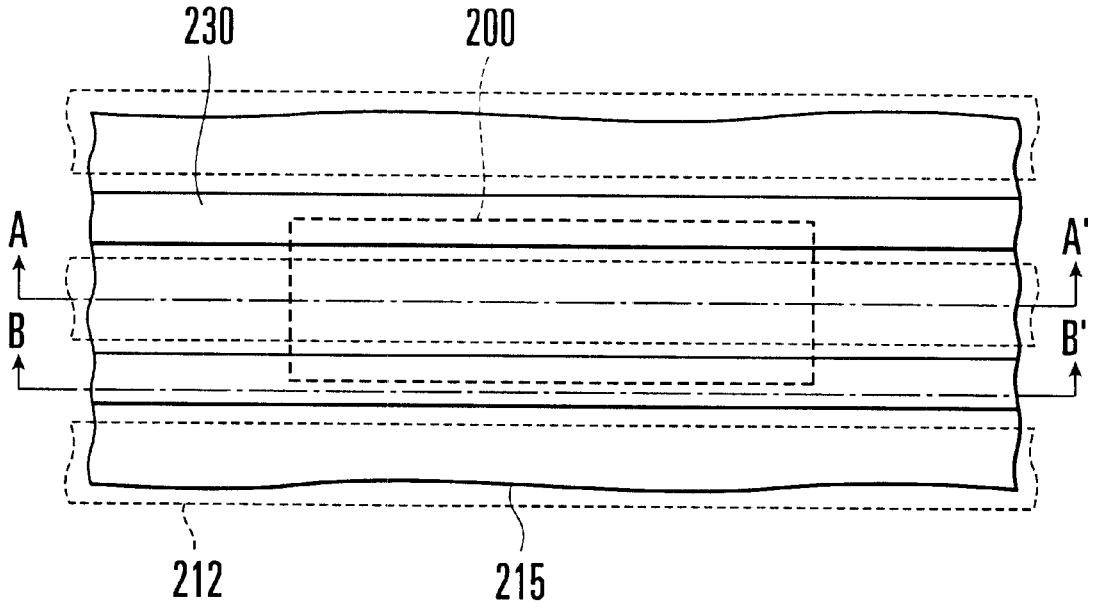
FIG.9A PRIOR ART
FIG. 9A is a plan view of the PDP shown in FIGS. 10A and 10B.
Figure 9B:
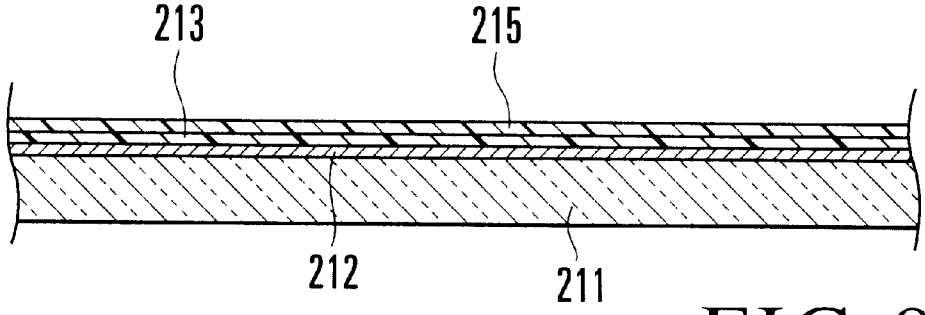
FIG.9B PRIOR ART
FIGS. 9B and 9C are sectional views taken along the lines A–A' and B–B', respectively, of FIG. 9A.
Figure 9C:
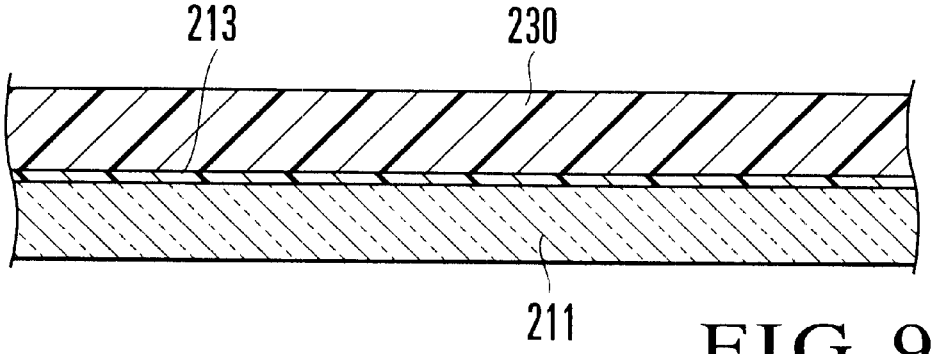
FIG.9C PRIOR ART
Figure 10A:
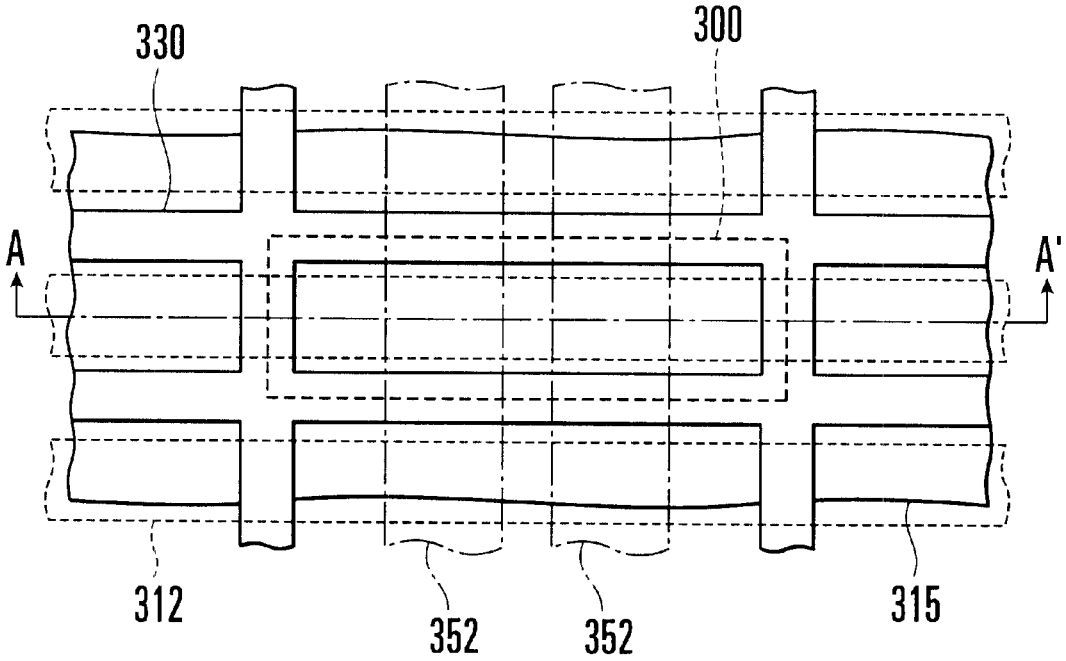
FIG.10A PRIOR ART
FIG. 10A is a plan view of a PDP according to the first prior art.
Figure 10B:
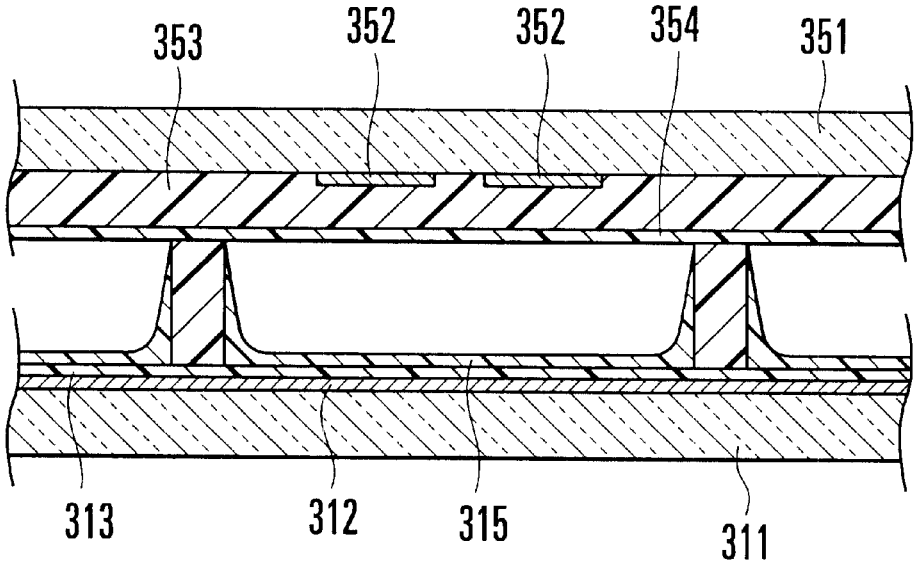
FIG.10B PRIOR ART
FIG. 10B is a sectional view taken along the line A–A' of FIG. 10A.
Figure 11A:
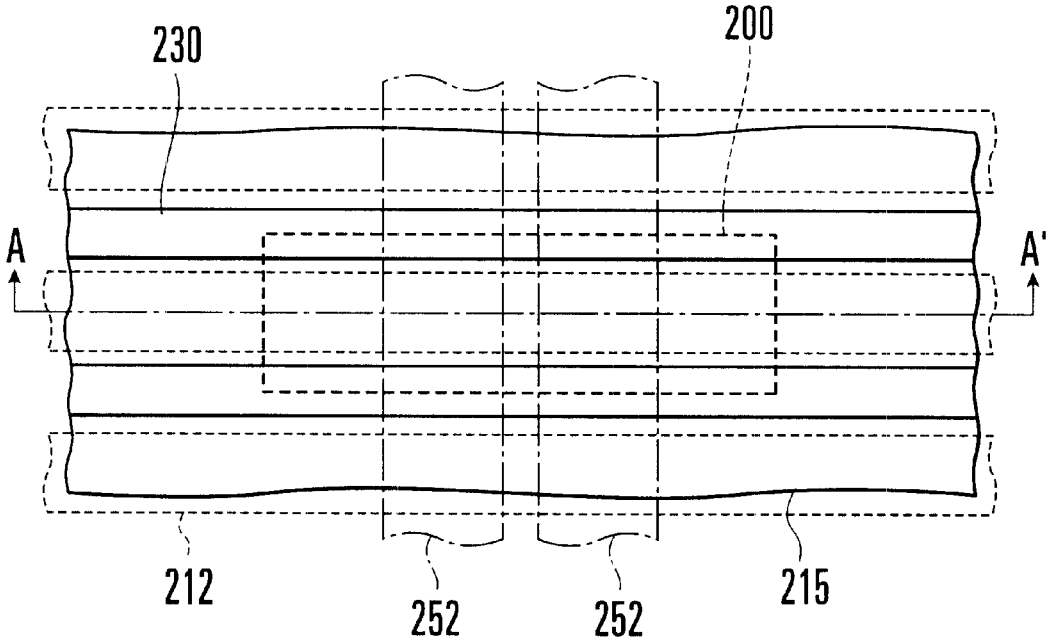
FIG. 11A PRIOR ART
FIG. 11A is a plan view of a PDP according to the second prior art.
Figure 11B:
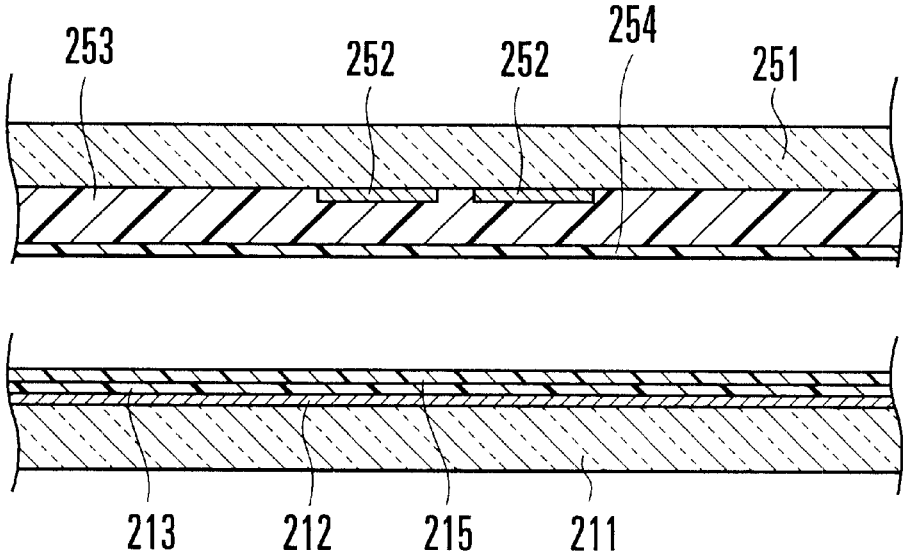
FIG. 11B PRIOR ART
FIG. 11B is a sectional view taken along the line A–A' of FIG. 11A.
Figure 12A:
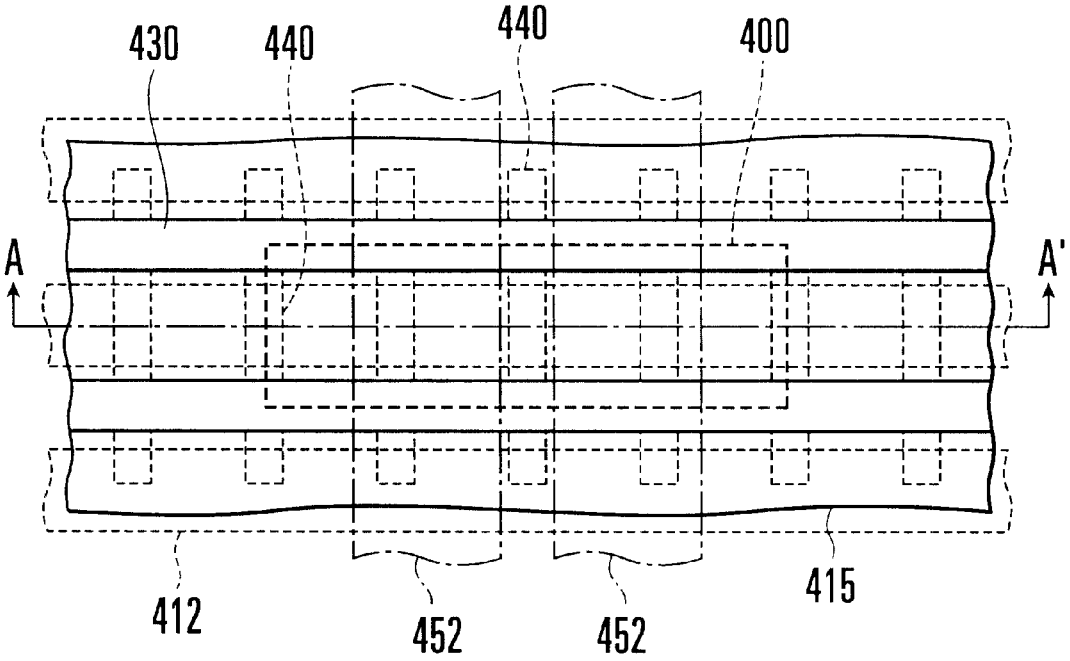
FIG.12A PRIOR ART
FIG. 12A is a plan view of a PDP according to the third prior art.
Figure 12B:
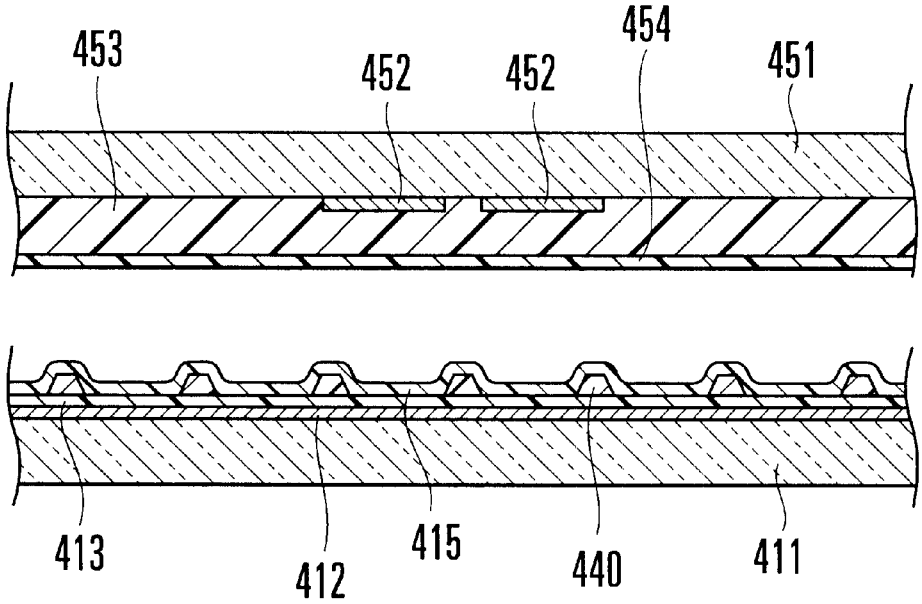
FIG.12B PRIOR ART
FIG. 12B is a sectional view taken along the line A–A' of FIG. 12A.

FIGS. 8A and 8B show a PDP according to the sixth embodiment of the present invention. In this embodiment, a lower dielectric layer 59 is formed partly on a pair of sustain discharge electrodes 52. A pair of upper sustain discharge electrodes 58 are formed on the lower dielectric layer 59 such that they are separated from the pair of sustain discharge electrodes 52 by the lower dielectric layer 59. The thickness of the dielectric layer 59 differs between the respective electrodes and discharge space.

The pair of sustain discharge electrodes 52 are connected to the pair of upper sustain discharge electrodes 58 through trace electrodes 155 formed to overlap light-shielding portions 60. In this case as well, the trace electrodes 155 are formed at regions opposing linear partitions 30 on the second substrate, as well as on the light-shielding portions 60, and are connected to the pair of upper sustain discharge electrodes 58 through these regions.

Consequently, in this embodiment as well, the thickness of a dielectric layer 53 on the pair of upper sustain discharge electrodes 58 can be decreased to be smaller than other portions thereof, so this embodiment has the same effect as that of the fifth embodiment in this respect. Conventionally, it is difficult to uniformly control a small thickness of the dielectric layer 53 on the projecting electrodes in the whole PDP. In contrast to this, according to this embodiment, the thickness of the dielectric layer 53 on the pair of upper sustain discharge electrodes 58 can be controlled stably.

In particular, in the fifth and sixth embodiments, regarding the conditions for the gas to fill the space between the first and second substrates, assume that the gas component for mainly generating ultraviolet light is Xe, Kr, Ar, or nitrogen, and that its partial pressure is 100 hPa or more. In this case, since discharge that generates ultraviolet light strongly can be realized within a narrower discharge region, the above conditions are effective in improving the light emission efficiency of the PDP.

Figure 13A:
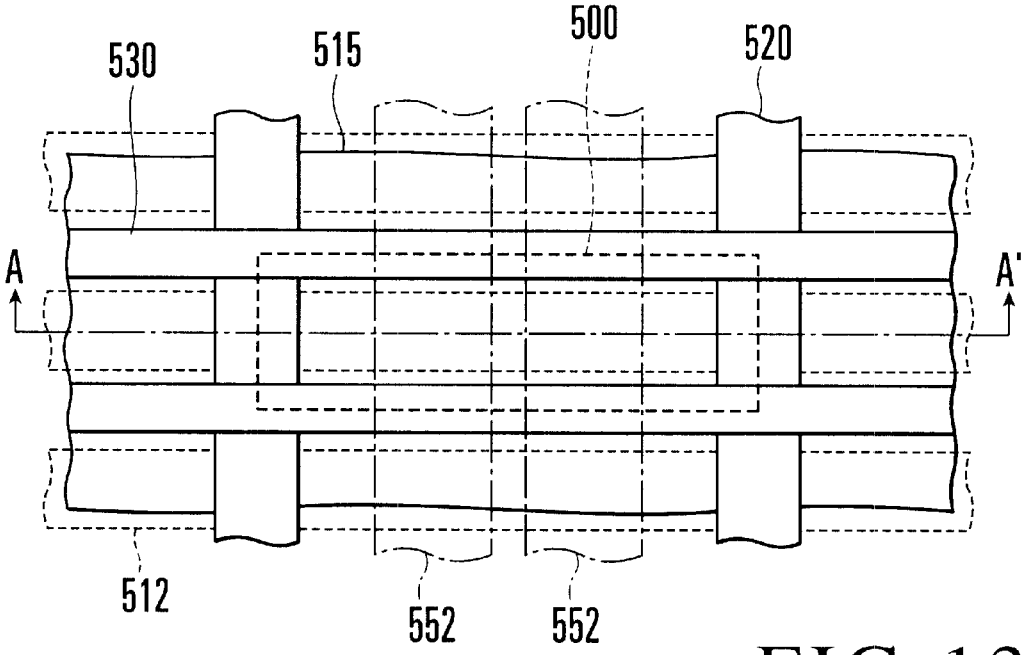
FIG. 13A PRIOR ART
FIG. 13A is a plan view of a PDP according to the fourth prior art.
Figure 13B:
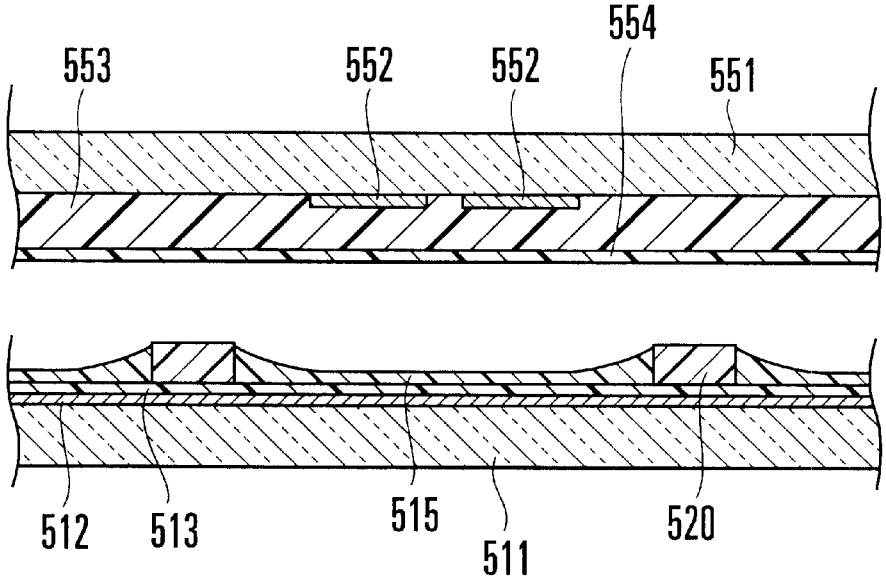
FIG. 13B PRIOR ART
FIG. 13B is a sectional view taken along the line A–A' of FIG. 13A.

In the above embodiments, a structure in which the notched openings 301 are formed in the linear partitions 30 of the first substrate 11 is described. When the characteristics of the PDP are studied comprehensively, an arrangement in which the light emission efficiency is improved while sacrificing the characteristics of vacuum evacuation to a certain degree may also be possible. To realize this arrangement, the structure of the first substrate 11 should have the same arrangement as that shown in FIGS. 13A and 13B in which the linear partitions 30 have no notched openings and the linear partitions are formed to cross over the stepped partitions 20. Also, the conditions for the gas to fill the space between the first and second substrates 11 and 51 is set such that the gas component for mainly generating ultraviolet light is Xe, Kr, Ar, or nitrogen, and that its partial pressure is 100 hPa or more. Also, when the second substrate 51 has the structure of the fifth or sixth embodiment, discharge that can generate ultraviolet light strongly can be realized even if the width of the pair of sustain discharge electrodes is decreased.

With this arrangement, although vacuum evacuation leaves room for improvement to a certain degree, the light emission efficiency of the PDP can be improved, and satisfactory characteristics can be obtained as the comprehensive characteristics of the PDP.

The embodiments of the present invention are described concerning a case wherein main discharge is caused by surface discharge electrodes. When the structure of the present invention is applied to a PDP in which pairs of sustain discharge electrodes are respectively formed on the first and second substrates to form a pair, the same effect as those of the embodiments of the present invention can be obtained. More specifically, in a so-called opposite type PDP with an arrangement in which an electrode arranged on a second substrate 51 and having a width corresponding to the width of the pair of sustain discharge electrodes 52 shown in FIGS. 3A and 3B, and data electrodes 12 of a first substrate 11 form a pair of discharge electrodes that cause main discharge for exciting the phosphor layer to emit light, the same effect as that of the surface discharge type PDP described above can be observed.

As has been described above, with the PDP according to the present invention, a partition structure to be formed on the data electrode side substrate is formed of linear partitions and partitions intersecting them and having a height smaller than that of the linear partitions, and the linear partitions have notches at their intersections. With this structure, vacuum evacuation of the discharge cell in the PDP fabricating process is facilitated more than in the prior art, and a high brightness and high light emission efficiency can be obtained, so the display quality can be improved consequently.

What is claimed is:

1. A plasma display panel comprising:

a first substrate;

a plurality of selection electrodes which are formed parallel to each other on said first substrate and to which a selection voltage is to be applied;

a first dielectric layer covering a surface of said first substrate to include said selection electrodes;

a plurality of first partitions formed at a predetermined interval on said first substrate to be parallel to said selection electrodes;

a second substrate arranged to oppose said first substrate, a closed space between said first and second substrates being filled with a gas;

a plurality of pairs of discharge electrodes which are formed on said second substrate to intersect said selection electrodes and between which a discharge voltage is to be applied, intersections of said pairs of discharge electrodes and said selection electrodes forming a matrix-like discharge cells;

a plurality of second partitions which are formed at a predetermined interval on said first substrate in a direction intersecting said first partitions and have heights smaller than those of said first partitions; and notched openings formed in said first partitions at intersections of said first and second partitions.

2. A panel according to claim 1, wherein said selection electrodes intersect said second partitions under said second partitions.

3. A panel according to claim 1, wherein said selection electrodes intersect said second partitions above said second partitions.

4. A panel according to claim 1, wherein said second partitions have substantially flat upper surfaces in a direction along said first partitions, and a gap between the upper surfaces of adjacent ones of said second partitions is 1.0 to 1.5 times a distance between outer edges of said pairs of discharge electrodes.

5. A panel according to claim 1, wherein said second partitions have substantially flat upper surfaces in a direction along said first partitions, and a width of each of the upper surfaces of said second partitions is 0.3 to 0.5 times a pitch of said second partitions.

6. A panel according to claim 1, further comprising a phosphor layer, on said dielectric layer of said first substrate, to expose the upper surfaces of said second partitions at least partly.

7. A panel according to claim 1, wherein a discharge region formed by said pairs of discharge electrodes is arranged between upper surfaces of adjacent ones of said second partitions.

8. A panel according to claim 1, wherein each of said second partitions has a substantially trapezoidal section.

9. A panel according to claim 1, wherein said panel further comprises a lower dielectric layer formed on said second substrate to cover at least opposing electrode side portions of said pairs of discharge electrodes, a pair of upper discharge electrodes formed on said lower dielectric layer and vertically separated from said pairs of discharge electrodes serving as a pair of lower discharge electrodes, and an upper dielectric layer for covering portions of the pair of lower discharge electrodes which are not covered by said lower dielectric layer and for covering said pair of upper discharge electrodes, and corresponding electrodes of the pair of lower discharge electrodes and said pair of upper discharge electrodes are connected to the same potential.

10. A panel according to claim 1, wherein the gas contains at least one excitation gas selected from the group consisting of Xe, Ke, Ar, and nitrogen as a component for generating ultraviolet light that excites a phosphor, the excitation gas having a partial pressure of not less than 100 hPa.

11. A panel according to claim 1, wherein said second partitions are made of the same material as that of said first partitions.

12. A panel according to claim 1, wherein said second partitions are made of a material with a relative dielectric constant of not less than 10.

13. A panel according to claim 1, wherein said second partitions are made of a low-melting glass material containing a white pigment powder.

14. A panel according to claim 1, wherein said second partitions are exposed to said notched openings at least partly.

15. A panel according to claim 14, wherein said notched openings accommodate said second partitions.

16. A panel according to claim 1, wherein said panel further comprises a second dielectric layer covering an upper surface of said second substrate including said pairs of discharge electrodes, and opposing electrode side portions of said pairs of discharge electrodes project toward a discharge space, and a thickness of portions of said second dielectric layer which correspond to the projecting electrode side portions decreases.

17. A panel according to claim 16, further comprising an underlying dielectric layer formed under the projecting electrode side portions.

18. A plasma display panel comprising:

a first substrate;

a plurality of selection electrodes which are formed parallel to each other on said first substrate and to which a selection voltage is to be applied;

a first dielectric layer covering a surface of said first substrate to include said selection electrodes;

a plurality of first partitions formed at a predetermined interval on said first substrate to be parallel to said selection electrodes;

a second substrate arranged to oppose said first substrate, a closed space between said first and second substrates being filled with a gas;

a plurality of pairs of discharge electrodes which are formed on said second substrate to intersect said selection electrodes and between which a discharge voltage is to be applied, intersections of said pairs of discharge electrodes and said selection electrodes forming a matrix-like discharge cells;

a plurality of second partitions which are formed at a predetermined interval on said first substrate in a direction intersecting said first partitions and have heights smaller than those of said first partitions;

notched openings formed in said first partitions at intersections of said first and second partitions; and a light-shielding portion, on said second substrate, to oppose upper surfaces of said second partitions.

19. A panel according to claim 18, wherein said second partitions have substantially flat upper surfaces in a direction along said first partitions, and said light-shielding portion has a width 0.8 to 1.2 times a width of each of the upper surfaces of said second partitions.

20. A panel according to claim 18, further comprising resistance decreasing interconnections formed on a region on said second substrate which opposes said light-shielding portion, connected to said pairs of discharge electrodes, and adapted to decrease resistances of extended interconnections of said pairs of discharge electrodes.

21. A panel according to claim 20, wherein said resistance decreasing interconnections are made of one element selected from the group consisting of a metal thin film, a metal powder, and a mixture of a metal powder and low-melting glass.

22. A panel according to claim 20, further comprising a connecting interconnection formed in a region on said second substrate which opposes said first partitions and adapted to connect said resistance decreasing interconnections and said pairs of discharge electrodes to each other.

23. A plasma display panel comprising:

a first substrate;

a plurality of selection electrodes which are formed parallel to each other on said first substrate and to which a selection voltage is to be applied;

a first dielectric layer covering a surface of said first substrate to include said selection electrodes;

a plurality of first partitions formed at a predetermined pitch on said first substrate to be parallel to said selection electrodes;

a second substrate arranged to oppose said first substrate, a closed space between said first and second substrates being filled with a gas;

a plurality of pairs of discharge electrodes which are formed on said second substrate to intersect said selection electrodes and between which a discharge voltage is to be applied, intersections of said pairs of discharge electrodes and said selection electrodes forming matrix-like discharge cells, wherein said pairs of discharge electrodes are formed such that a distance between a discharge space and each of said pairs of electrodes gradually decreases toward the center of each of said pairs; and a plurality of second partitions which are formed at a predetermined pitch on said first substrate in a direction intersecting said first partitions and have heights smaller than those of said first partitions, wherein said first partitions cross over said second partitions at intersections with said second partitions.

24. A panel according to claim 23, wherein said panel further comprises a second dielectric layer covering an upper surface of said second substrate including said pairs of discharge electrodes, and opposing electrode side portions of said pairs of discharge electrodes project toward a discharge space, and a thickness of portions of said second dielectric layer which correspond to the projecting electrode side portions decreases, wherein a thickness of the second dielectric layer gradually decreases toward opposing ends of the electrodes.

25. A panel according to claim 23, wherein said panel further comprises a lower dielectric layer formed on said second substrate cover at least opposing electrode side portions of said pairs of discharge electrodes, a pair of upper electrodes formed on said lower dielectric layer and vertically separated from said pairs of electrodes serving as a pair of lower electrodes, and an upper dielectric layer for covering portions of the pair of lower electrodes which are not covered by said lower dielectric layer and for covering said pair of upper electrodes, and corresponding electrodes of the pair of lower electrodes and said pair of upper electrodes are connected to the same potential.

26. A method of manufacturing a display panel, comprising:

forming a plurality of selection electrodes parallel to each other on a first substrate;

forming a first dielectric layer on the first substrate including the selection electrodes;

forming a second partition on the first dielectric layer; and forming a first partition having a notched opening at an intersection of the first and second partitions in a direction intersecting the first partition, on the first dielectric layer.

27. A method according to claim 26, further comprising:

forming a pair of discharge electrodes on a second substrate, forming a second dielectric layer on the second substrate including the pair of discharge electrodes, arranging the second substrate to oppose the first substrate such that the pair of discharge electrodes correspond to a space between second partitions, and filling a closed space between the first and second substrates with a gas.

28. A method according to claim 26, wherein the forming the second partition comprises forming the second partition with a height smaller than that of the first partition.

29. A method according to claim 28, wherein the forming the first partition comprises:

forming a height adjustment layer on a flat upper surface of the second partition, forming a first partition material on the first substrate to be flush with a surface of the height adjustment layer, selectively removing the first partition material, thereby forming the first partition parallel to the selection electrodes, and removing the height adjustment layer after removing the first partition.

30. A method according to claim 28, wherein the forming the first and second partitions comprise forming a second partition material layer on an entire surface of the first substrate, forming a first partition material layer on an entire surface of the first substrate, and selectively removing the first and second partition materials in the same removing process to form the first partition comprising the first and second partition materials and the second partition comprising the second partition material.

31. A method according to claim 28, wherein the forming the first and second partitions comprise forming a second partition material layer on an entire surface of the first substrate, forming a striped second partition mask pattern on the second partition material, forming a first partition material layer on an entire surface of the first substrate to form a substantially flat surface together with a surface of the second partition mask pattern, forming a first partition mask pattern on the first partition material so as to intersect the second partition mask pattern, and removing the first and second partition materials by using the first and second partition mask patterns as a mask to form the first partition comprising the first and second partition materials and the second partition comprising the second partition material.

32. A method according to claim 31, wherein the first and second partition mask patterns are formed of dry films.

33. A method according to claim 28, wherein the forming the first partition comprises forming a second partition material and a second partition mask pattern, and thereafter covering the second partition material in a region which is not covered with the second partition mask pattern, with a first partition material layer, and selectively removing the first partition material layer, thereby forming the first partition parallel to the selection electrodes.

34. A method according to claim 33, wherein the first partition is formed by sandblasting.

35. A plasma display panel, comprising:

a plurality of first partitions formed at a predetermined interval on a first substrate;

a plurality of second partitions formed at a predetermined interval on said first substrate in a direction intersecting said first partitions and having heights smaller than those of said first partitions; and notched openings formed in said first partitions at intersections of said first and second partitions.

36. A panel according to claim 35, wherein the notched openings are formed to coincide with the upper surfaces of the second partitions.

37. A panel according to claim 35, wherein the notched openings are formed such that a first side of each of the notched openings is located above a side of each of the second partitions.

* * * * *